United States Patent [19]

Faulstich

[11] 3,979,002

[45] Sept. 7, 1976

[54] TEARABLE SKIRT PLASTIC WATER BOTTLE CAP

[75] Inventor: George W. Faulstich, San Carlos, Calif.

[73] Assignee: Three Sisters Ranch Enterprises, San Carlos, Calif.

[22] Filed: Jan. 13, 1975

[21] Appl. No.: 540,397

[52] U.S. Cl. ..... 215/256; 215/DIG. 1

[51] Int. Cl.[2] ..... B65D 41/48

[58] Field of Search ..... 215/254, 256, DIG. 1

[56] References Cited

UNITED STATES PATENTS

| | | | |
|---|---|---|---|
| 3,392,860 | 7/1968 | Faulstich | 215/254 |
| 3,392,862 | 7/1968 | Faulstich | 215/254 |
| 3,434,613 | 3/1969 | Langecker | 215/321 X |
| 3,696,957 | 10/1972 | Van Baarn | 215/321 X |
| 3,840,137 | 10/1974 | Faulstich | 215/256 |

FOREIGN PATENTS OR APPLICATIONS

| | | | |
|---|---|---|---|
| 878,606 | 6/1953 | Germany | 215/DIG. 1 |

*Primary Examiner*—Donald F. Norton
*Attorney, Agent, or Firm*—Julian Caplan

[57] ABSTRACT

A plastic bottle cap for large capacity water bottles has a central disc with a depending skirt which fits snugly around the exterior of the bottle neck and, so long as it remains intact, prevents tampering with the contents. The lower part of the skirt is scored and provided with a pull tab so that it may be partially torn off, permitting removal of the cap from the bottle neck. The score line slants upwardly from the bottom edge of the skirt to a circumferential score line extending only part way around the cap and located slightly below the maximum diameter area of the external bead of the cap which is installed over the external bead on the bottle neck. A pair of internal, thin, flexible circumferential rings are formed in the cap immediately above the score line and at about said maximum diameter to engage the neck bead and prevent leakage. In one form of the invention, the skirt is internally tapered to facilitate installation of the cap. In this form, the bottle neck has a flat shoulder on which the bottom edge of the cap skirt rests, inhibiting dust and other contaminants from penetrating under the skirt.

4 Claims, 8 Drawing Figures

TEARABLE SKIRT PLASTIC WATER BOTTLE CAP

This application is an improvement upon U.S. Pat. No. 3,392,860.

This invention relates to a new and improved tearable skirt plastic water bottle cap and bottle neck combination.

The caps of the present invention are of a type used on five-gallon water bottles having screw necks or crown necks or of similar capacity. A skirt depends from a top disc, fitting snugly around the exterior of the neck of the bottle, and, so long as it remains intact, prevents tampering with the contents. The lower part of the skirt is scored and provided with a pull tab so that it may be partially torn off, thereby making it possible to remove the cap from the bottle neck to dispense the contents.

Prior to tearing the skirt, the upper part of the neck of the bottle is sealed against contamination from dirt. When the skirt is torn and the cap removed, this may be done in such a manner that the hands of the user do not have to come in contact with the upper end of the neck, thereby avoiding contamination. Thus a principal feature of the invention is the improved sanitation which results.

After the cap has been removed and part of the contents of the bottle dispensed, the remaining portion of the cap may be reinstalled on the bottle to prevent dirt from entering. When the bottle is completely empty and is being returned to the bottling works for refilling, the cap may be installed and this, although not preventing leakage, nevertheless, protects the upper edge of the bottle from chipping or cracking. Thus the remaining portion of the cap is useful as a temporary protection of the contents of the bottle against contamination and also as a protection of the bottle during transportation back to the bottling works.

Water bottles are conventionally produced by manufacturers in several types. In one type shown herein, a screw cap is the primary intended enclosure and there is an upper terminal portion of the neck which is exteriorly screw threaded to receive such a screw cap. Such caps are generally unsatisfactory, however, and the present cap is far superior for sealing the bottle. On the other hand, other bottles do not have screw cap extensions and originally were intended for cork closure. The present cap may be used to close and seal either type of water bottle. In still a third type of cap, there is a horizontal shoulder formed on the neck below the upper external bead. In one form of cap hereinafter described, the lower edge of the cap skirt fits snugly on this shoulder and prevents contaminants from entering into the space between the inside of the skirt and the bottle neck.

One of the features of the present invention is the provision of means which limits the tearing of the skirt to a predetermined arcuate length so that the skirt is not completely torn off.

Another feature of the invention is the provision of flexible internal circumferential rings immediately above the location of the horizontal tear line which bear against the maximum diameter portion of the upper neck bead, preventing leakage. The flexibility of the leak rings is such that minor marring of the bead surface is overcome by reason of the flexibility of the leak rings.

Another feature of the invention is the fact that the horizontal score line along which the cap is torn is located immediately below the leak rings and below the maximum diameter of the external bead of the cap. In this way, the cap fits on the bead more easily after the skirt has been partially torn off.

In one of the forms of the invention, the skirt is thickened and its lower edge is internally tapered downwardly-outwardly. The taper facilitates forcing of the cap on to the bottle neck by automatic bottle cap applying machines.

Other objects of the present invention will become apparent upon reading the following specification and referring to the accompanying drawings in which similar characters of reference represent corresponding parts in each of the several views.

Figure 2:
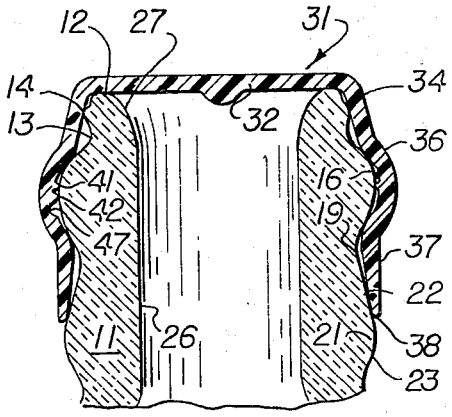
FIG. 2 is an enlarged vertical mid-sectional view showing the cap and bottle neck in assembled position.
Figure 1:
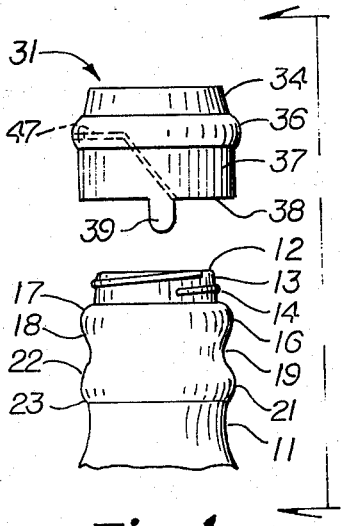
FIG. 1 is an exploded side elevational view of one form of cap formed in accordance with the present invention and the upper portion of a bottle neck with which the cap is used.

A conventional type of water bottle of approximately five-gallon capacity used for spring water, distilled water, etc., is shown in FIGS. 1 and 2. Neck 11 terminates in an upper edge or finish 12. Immediately below finish 12 the neck has a small diameter cylindrical upper terminal portion 13 provided with an external screw thread 14 of slightly more than one turn. Such thread 14 is intended for use with a metal screw cap, but such screw cap is not used in accordance with the present invention. Below terminal portion 13 is an external upper bead 16 having a substantially arcuate upper corner 17 and a downwardly-inwardly tapered lowered curvature 18 which terminates in a minimum diameter portion 19 which is substantially the same as the diameter of terminus 13. Below minimum diameter portion 19 is a second bead 21 having an upper curvature 22 which extends downwardly-outwardly in a curve 22 and then curves inwardly-downwardly in a circular arc 23 merging with the upper end of neck 11. Customarily, the bottle is made of glass, although the present invention contemplates rigid plastic substitutes for glass. The interior of the bottle neck 11 has a generally cylindrical inner diameter 26 terminating at its upper end adjacent finish 12 in an outwardly flaring bevel 27.

Cap 31 is a single piece, thin-walled plastic cap of polyethylene or polystyrene or other material. The plastic is sufficiently resilient so as to slip over the external beads of the bottle neck 11 and yet snap back to form a tight seal as heretofore described. The material is further characterized by the fact that it may be torn by the fingers along a score line as hereinafter explained.

Cap 31 has a top circular disc 32 having an external diameter about equal to the outside diameter of the top finish 12. Around the perimeter of disc 32 is an upper skirt portion 34 which is approximately cylindrical, but in practical construction tapers downwardly-outwardly and which has an inside diameter equal to the outside diameter of thread 14 and a length such that its lower end abuts surface 17 of bead 16. The thread 14 seals against the interior of portion 34. Below portion 34 is an external bead 36 which is complementary to bead 16 and terminates in a vertical skirt 37 having a lower edge 38 which fits over and seals against the surface 22 of bead 21. Depending from the bottom edge 38 is a tab 39. A pair of circumferential, thin, flexible, internal leak rings are formed inside bead 36 at about the maximum diameter of bead 16 and sealing there-against to prevent leakage. Occasionally after use the bead 16 is scratched or chipped. The rings 41, 42 accommodate such irregularities in the surface of bead 16.

Figure 3:
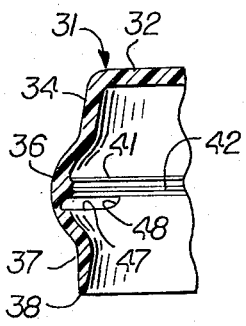
FIG. 3 is a fragmentary sectional view of the cap shown in a position turned approximately 90° from the position shown in FIG. 2.
Figure 4:
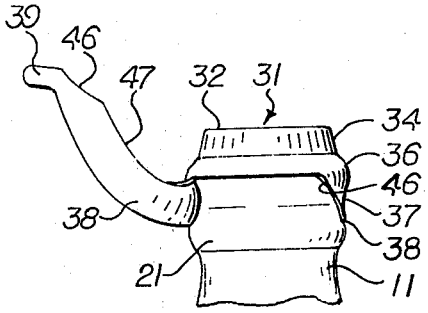
FIG. 4 is a partially schematic side elevational view showing the skirt in the act of being torn preliminary to removal of the cap.

Slanting upwardly at approximately a 45° angle from the bottom edge 38 of skirt 37 immediately to the right of tab 39 as viewed in FIG. 1 is internal slanted score line 46 which extends upward to a location slightly below the maximum diameter of bead 36 and below the lower ring 42. Score line 46 merges with horizontal score line 47. The arcuate length of score line 47 is preferably approximately 180°. Score lines 46, 47 are sufficiently deep so that when the user grips the tab 39 and pulls upwardly and outwardly as best illustrated in FIG. 4, the skirt tears along said lines to permit removal of cap 31. To prevent the skirt 37 from being torn completely off, a thickening 48 is formed in the inside of skirt 37 beyond the terminus of score line 47 (see FIG. 3). The thickening 48 is integral with the material of which the skirt is formed.

In use, cap 31 is installed by pressing downward, the diameter of skirt 37 being greater than the cylindrical portion 13 and hence fits easily over that portion. By reason of the fact that surfaces 17 and 22 are rounded, when downward pressure is applied on cap 31, the cap stretches so that it slips over bead 16 and then contracts to its initial condition with tight sealing engagement against bead 16 and the upper surface 22 of bead 21 as well as with threaded portion 14 and lip 12. In such position, the contents of the bottle are not subject to tampering, since the cap cannot be removed without tearing the skirt. Water cannot leak out of the bottle nor can dirt or other contaminants enter. Of equal importance is the fact that the exterior of the bottle around the neck is also protected from contaminants.

When the bottle reaches its destination, it is customarily unloaded from a truck by the driver and installed in a water cooler, although such end use is not essential to practice of the present invention. The user grasps tab 39 and pulls upwardly and outwardly with a twisting motion as best illustrated in FIG. 4, tearing along lines 46 and 47 until the terminal thickening portion 48 is reached. Continued pulling on tab 39 upwardly and outwardly unseats caps 31 from the neck of the bottle, the plastic stretching sufficiently after the skirt has been torn as indicated to permit removal of the cap. The hands of the user are far removed from the upper end of the neck, and hence the danger of contamination of the surface or of the contents by contact with the hands is eliminated.

When desired, the cap in the condition shown in FIG. 4 may be used for reclosure purposes. The cap fits on the bottle neck sufficiently tightly to prevent dirt from contaminating the water, and in fact, the cap is partially water-tight under normal storage conditions. A principal purpose of the perforated cap, however, is the fact that it may be reapplied to an empty bottle; and when thus used, protects the bottle from chipping or cracking during transportation back to the bottling works.

Figure 5:
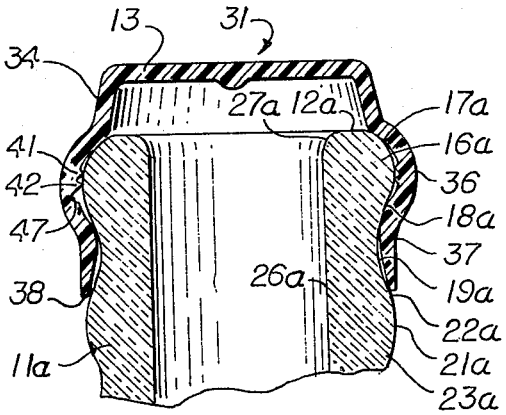
FIG. 5 is a view similar to FIG. 2 showing a modified bottle neck used with the same cap as in FIG. 2.

A common alternate construction of a bottle neck **11*a* is shown in FIG. 5. The terminus 13 is eliminated. Neck 11*a*** is in other respects similar to that of the preceding modification and similar characters of reference are used followed by the subscript *a*. Cap 31 is identical with that of the preceding modification. The portion 34 extends up above the finish **12*a* and comprises a cushion against shock when the bottles are racked in a truck for transportation. Thus a feature of the invention is the fact that the identical cap 31 may be used for the bottle neck 11 of FIG. 2 or 11*a* of FIG. 5.**

Figure 7:
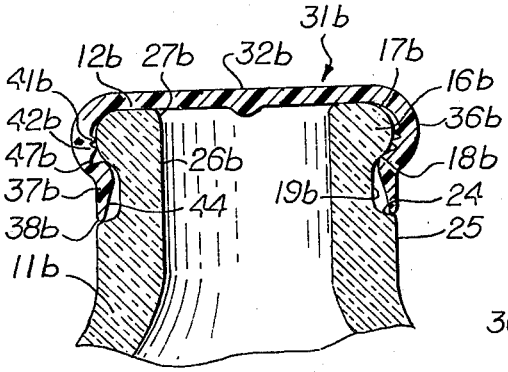
FIG. 7 is a view similar to FIG. 2 of the modification of FIG. 6.
Figure 8:
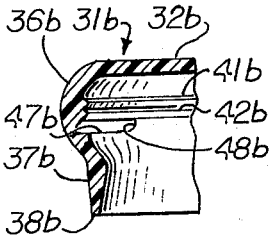
FIG. 8 is a view similar to FIG. 3 of the modification of FIG. 6.
Figure 6:
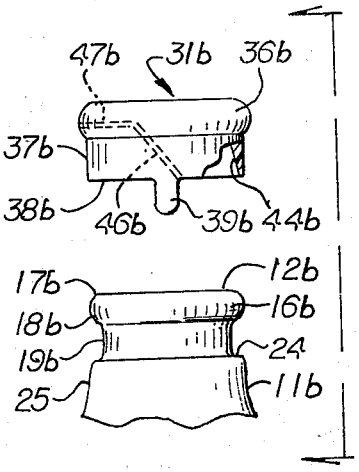
FIG. 6 is a view similar to FIG. 1 showing a modified cap and bottle neck and partially broken away.

Directing attention now to FIGS. 6–8, the bottle neck **11*b* is of modified construction but most closely resembles that shown in FIG. 5 (i.e. the terminus 13 of FIG. 2 is eliminated). However, below minimum diameter portion 19*b* is a substantially horizontal shoulder 24 and below shoulder 24 is an approximately cylindrical bead portion 25. The cap 31*b* resembles that of the preceding modification except that the skirt 37*b* is considerably shorter than that of FIGS. 1–5 and the lower edge 38*b* thereof rests on the shoulder 24 and seals there-against to prevent contaminants from entering the space between the skirt 37*b* and the minimum diameter portion 19*b*. Further, the skirt 37*b* is somewhat thicker than that of the preceding modification and the interior thereof is tapered outwardly as shown in reference numeral 44. The taper 44 facilitates installation of cap 31*b* on neck 21*b* by conventional bottle capping equipment. Thus the taper portion 44 seats on surface 17*b* and downward pressure applied to the cap 31*b* causes the cap to stretch over the bead 16*b*. In other respects, the cap 31*b* and neck 11*b* of the modification of FIGS. 6–8** resembles that of the preceding modification and the same reference numerals followed by the subscript *b* are used to designate corresponding elements.

What is claimed is:

1. In combination a container having a container neck having an annular finish at the end of said neck, a short cylindrical terminus below said finish formed with an external screw thread, an upper external first bead having a substantially circular arcuate upper corner and a downward tapering lower curvature ending in a minimum diameter portion and a second bead below said minimum diameter portion; and a cap of a flexible plastic material, said cap deformable to accommodate minor variations in container dimensions and also to permit said cap to stretch over said first bead, said cap preformed, said cap comprising a flat top disk having a diameter about equal to that of said finish, an external third bead below said disk complementary to and tightly engaging said first bead down to the upper end of said lower curvature, an imperforate vertical skirt below said external third bead having a diameter less than said first and second beads of said neck, and a short depending upper skirt around the periphery of said top disk above said external third bead and having an inside diameter slightly greater than said terminus and equal to said threads, said third bead being weakened in a first score line located opposite said downward tapering lower curvature and below the maximum diameter portion of said first bead, said first score line having an arcuate length of about 180°, said skirt formed with a thickened internal terminus at a first end of said first score line to limit tearing of said skirt, said skirt being formed with an internal, circumferential thin, flexible first leak ring immediately above said first score line and engaging said maximum diameter portion of said first bead and with an internal, circumferential, thin, flexible second leak ring above said first leak ring engaging said first bead, said skirt being weakened with an internal second score line extending from a second end of said first score line and slanting downward to the bottom edge of said skirt and a pull tab depending from the lower edge of said skirt below said second score line and immediately to the side of the point where said second score line intersects said bottom edge, said skirt being tearable along said second and first score lines, said cap in intact condition on said neck sealing said neck against either input or output of liquid, said cap when torn along said second and first score lines permitting removal of said cap from said neck.

2. The combination of claim 1 in which the inside surface of said skirt adjacent the lower edge of a skirt tapers outwardly to a diameter greater than that of said upper corner of said first bead, whereby installation of said cap on said neck may be facilitated by resting said lower edge of said skirt on said first bead and applying downward pressure on said cap.

3. A cap for use with a container having a neck having an annular finish at the end of said neck, a short cylindrical terminus below said finish formed with external screw threads, an upper external first bead having a substantially circular arcuate upper corner and a downward tapering lower curvature ending in a minimum diameter and a second bead below said minimum diameter portion, said cap formed of a flexible plastic material deformable to accommodate minor variations in container dimensions and also to permit said cap to stretch over said first bead, said cap being preformed, said cap comprising a flat top disk having a diameter about equal to that of the finish of said neck, an external third bead below said disk complementary to and, in the assembled position of said cap and neck, tightly engaging said first bead down to the upper end of said lower curvature, an imperforate vertical skirt below said external third bead having a diameter less than said first and second beads of said neck, and a short depending upper skirt around the periphery of said top disk above said external third bead and having an inside diameter slightly greater than said terminus and equal to said threads, said third bead being weakened in a first score line which in the assembled position of the cap and neck is located opposite the downward tapering lower curvature and below the maximum diameter portion of said first bead, said first score line having an arcuate length of about 180°, said skirt formed with a thickened internal terminus at a first end of said first score line to limit tearing of said skirt, said skirt also formed with an internal, circumferential, thin, flexible first leak ring immediately above said first score line and in said assembled condition engaging said maximum diameter portion of said first bead and with an internal, circumferential, thin, flexible second leak ring about said first leak ring engaging said first bead, said skirt being weakened with an internal second score line extending from a second end of said first score line and slanting downward to the bottom edge of said skirt and a pull tab depending from the lower edge of said skirt below said second score line and immediately to the side of the point where said second score line intersects said bottom edge, said skirt being tearable along said second and first score lines, said cap in intact condition on said neck sealing said neck against either input or output of liquid, said cap when torn along said second and first score lines permitting removal of said cap from said neck.

4. A cap according to claim 3 in which the inside surface of said skirt adjacent the lower edge of said skirt tapers outwardly to a diameter greater than that of said upper corner of said first bead, whereby installation of said cap on said neck may be facilitated by resting said lower edge of said skirt on said first bead and applying downward pressure on said cap.

* * * * *